United States Patent [19]

Hoshino

[11] 4,417,514

[45] Nov. 29, 1983

[54] PRINTING PLATE EXCHANGE SYSTEM

[75] Inventor: Noriyuki Hoshino, Mihara, Japan

[73] Assignee: Mitsubishi Jukogyo Kabushiki Kaisha, Tokyo, Japan

[21] Appl. No.: 407,784

[22] Filed: Aug. 13, 1982

[51] Int. Cl.[3] ..... B41L 45/08

[52] U.S. Cl. ..... 101/54

[58] Field of Search ..... 101/382 R, 54, 53

[56] References Cited

U.S. PATENT DOCUMENTS

| | | | |
|---|---|---|---|
| Re. 15,589 | 5/1923 | Chisholm | 101/54 |
| 876,913 | 1/1908 | Rogers | 101/54 |
| 1,209,411 | 12/1916 | Hughes | 101/54 |
| 1,621,678 | 3/1927 | Morse | 101/54 |
| 4,031,822 | 6/1977 | Wilson | 101/54 |

*Primary Examiner*—E. H. Eickholt

*Attorney, Agent, or Firm*—Wenderoth, Lind & Ponack

[57] ABSTRACT

An improved exchange system for a plate in a printing machine is described here, which comprises a unit box holding therein a plurality of plates each mounted to a fixture rod and capable of being disposed under a printing cylinder, said fixture rod having a slot adapted to engage with a fixture strip of the plate and a holding member for preventing the fixture strip from disengaging therefrom, and plate mount/dismount means disposed under said printing cylinder for mounting and dismounting the plate in said unit box onto and from said printing cylinder by the intermediary of said fixture rod.

1 Claim, 22 Drawing Figures

PRINTING PLATE EXCHANGE SYSTEM

The present invention relates to an exchange system for a plate in a printing machine.

Figure 1:
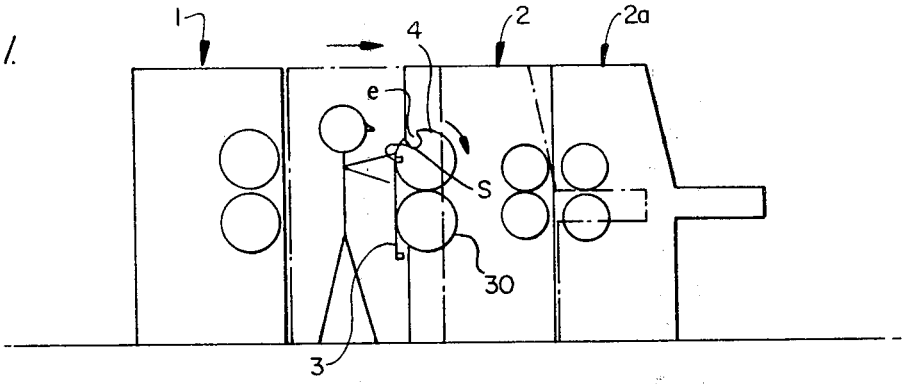

In general, printing sections in paper working machines are classified into two types of an upper printing type and a lower printing type, and in either type, mounting and dismounting of a plate sheet onto and from a printing cylinder have been carried out entirely through a manual operation, after a space for mounting a plate sheet (3) onto a printing cylinder (4) has been established by separating a printing section (2) and a paper feed section (2*a*) from a paper eject section (1) as shown in FIG. 1 which illustrates one example of the upper printing system in the prior art. The outline of this working procedure will be explained in the following.

Figure 2:
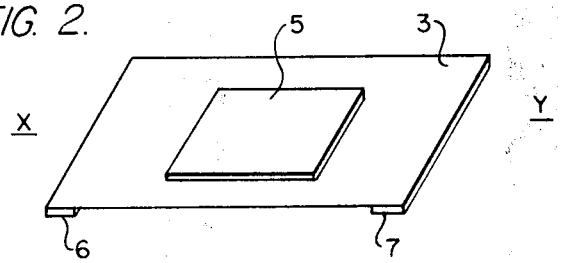

At first, explaining the mounting operation of the plate sheet (3), it consists of the following steps:

(a) A front fixture strip (6) of a plate sheet (3) as shown in FIG. 2 (X in FIG. 2 indicates a front side, while Y indicates a rear side) is inserted into a mounting slot (S) of a printing cylinder (4) shown in FIG. 1 to mount the front edge of the plate sheet (3) onto the printing cylinder (4).

(b) Then, the printing cylinder (4) is made to rotate in the direction of an arrow by actuating a push-button switch (not shown).

(c) Subsequently, the plate sheet (3) is wrapped around the printing cylinder (4) by one hand.

Figure 3A:
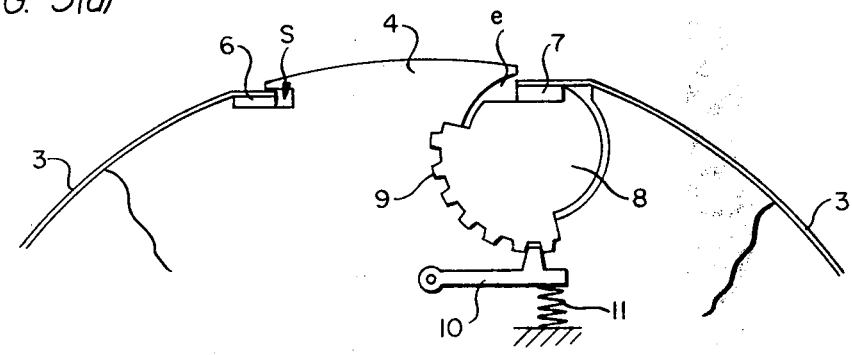
Figure 3B:
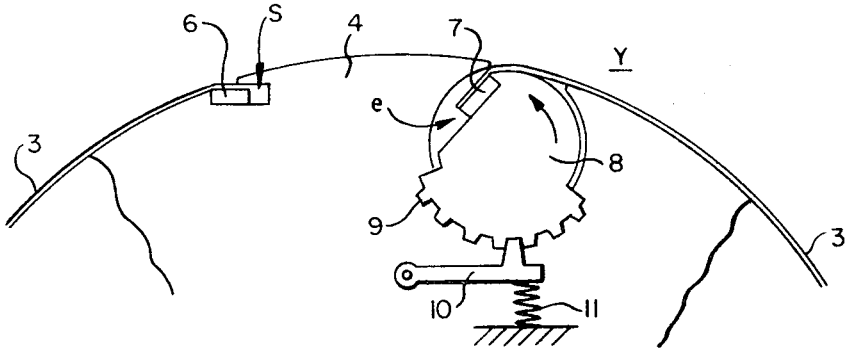

(d) Next, a rear fixture strip (7) is fitted into a slot (e) on the printing cylinder (4) (FIG. 3(*a*)).

(e) Further, a fastening shaft (8) is rotated in the direction of an arrow as shown in FIG. 3(*b*) to attract the plate sheet (3) from its rear end portion, and finally the plate sheet (3) is fixed in a stretched state by means of a ratchet wheel (9) provided on an end surface of the fastening shaft (8) and a claw (10). It is to be noted that reference numeral (5) in FIG. 2 denotes a plate for printing.

Next, explaining the dismounting operation of the plate sheet (3), it consists of the following steps:

(a) At first, the claw (10) is disengaged from the ratchet wheel (9) which has been engaged with the former.

(b) Then, the plate sheet (3) is relaxed by rotating the fastening shaft (8) in the direction opposite to the arrow (the state shown in FIG. 3(*a*)), and thereby the rear fixture strip (7) is disengaged from the slot (e).

(c) Subsequently, while the printing cylinder (4) is rotated in the direction opposite to the arrow in FIG. 1, the plate sheet (3) is unwrapped from its rear end portion.

(d) Further, the front fixture strip (6) is disengaged from the slot (S) on the printing cylinder (4) and then the plate sheet (3) is removed.

However, the above-mentioned process in the prior art had the following shortcomings. That is, as a preparatory step for exchanging the plate sheet (3) it was necessary to move the printing section (2) and the paper feed section (2*a*) from the position contiguous to the paper eject section (1) indicated by dash-dot lines to the position indicated by solid lines as shown in FIG. 1. Also, exchange of the plate sheet (3) had to entirely rely upon manual operations, and further, after the exchange was finished it was also necessary to restore the printing section (2) and the paper feed section (2*a*) which had been separated from the paper eject section (1) in the above-described manner to the position indicated by dash-dot lines in FIG. 1. Therefore, the process in the prior art had a disadvantage that a lot of labor and time were necessitated before operation was restarted.

It is a principal object of the present invention to provide a printing plate exchange system which is free from the above-mentioned shortcomings in the prior art.

A more specific object of the present invention is to provide a printing plate exchange system in which a time required for setup can be greatly shortened, hence a productivity is enhanced by the corresponding amount, and thereby labor saving and safety can be improved.

According to one feature of the present invention, there is provided a printing plate exchange system comprising a unit box holding therein a plurality of plates each mounted to a fixture rod and capable of being disposed under a printing cylinder, said fixture rod having a slot adapted to engage with a fixture strip of the plate and a holding member for preventing the fixture strip from disengaging therefrom, and plate mount-/dismount means disposed under said printing cylinder for mounting and dismounting the plate in said unit box onto and from said printing cylinder by the intermediary of said fixture rod.

Figure 4:
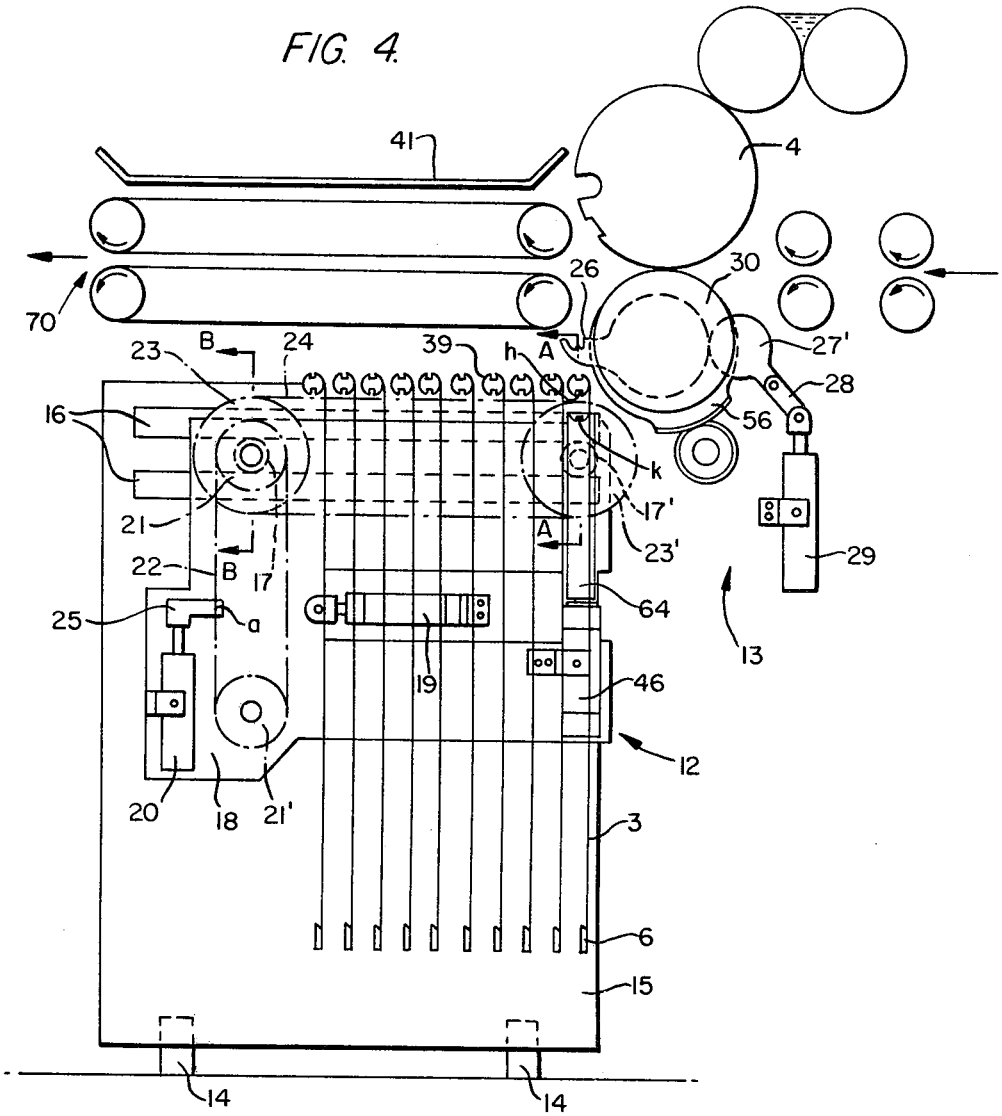
Figure 5:
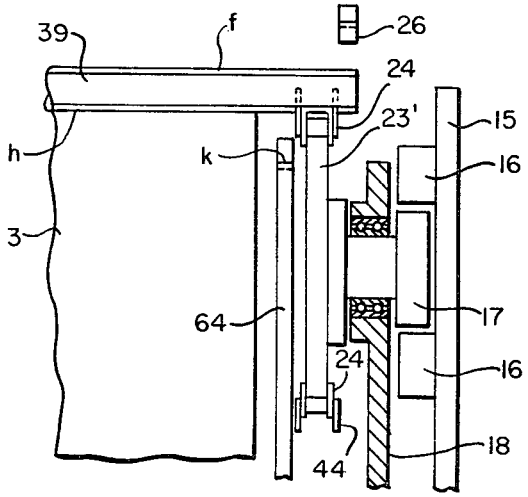
Figure 6:
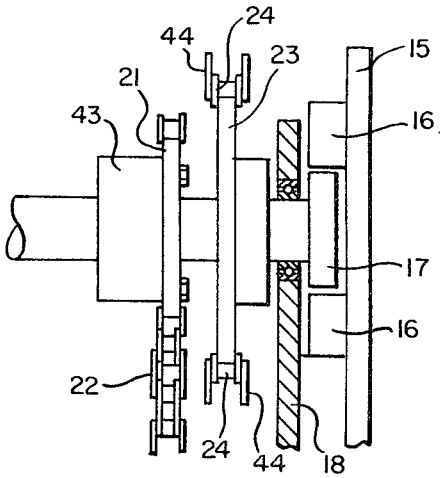
Figure 7:
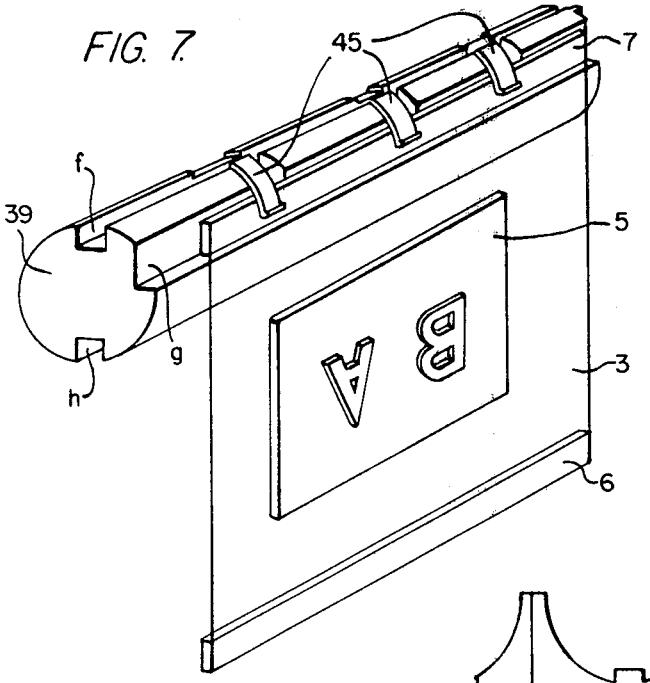
Figure 8:
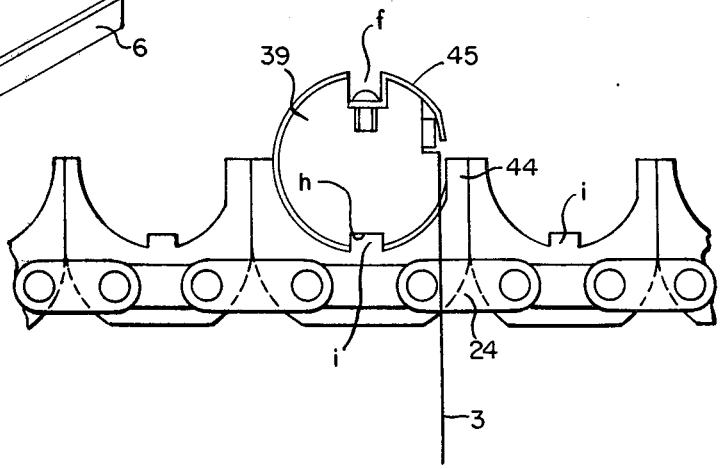
Figure 10:
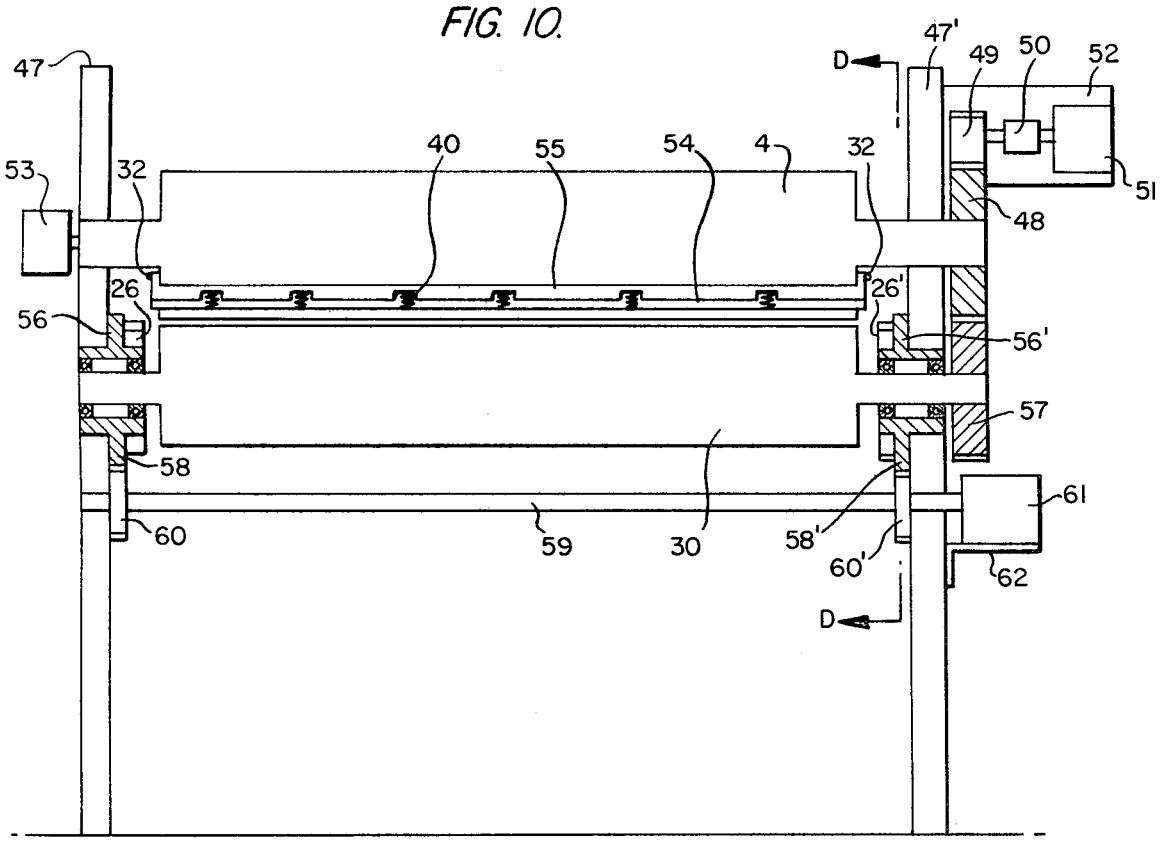
Figure 9:
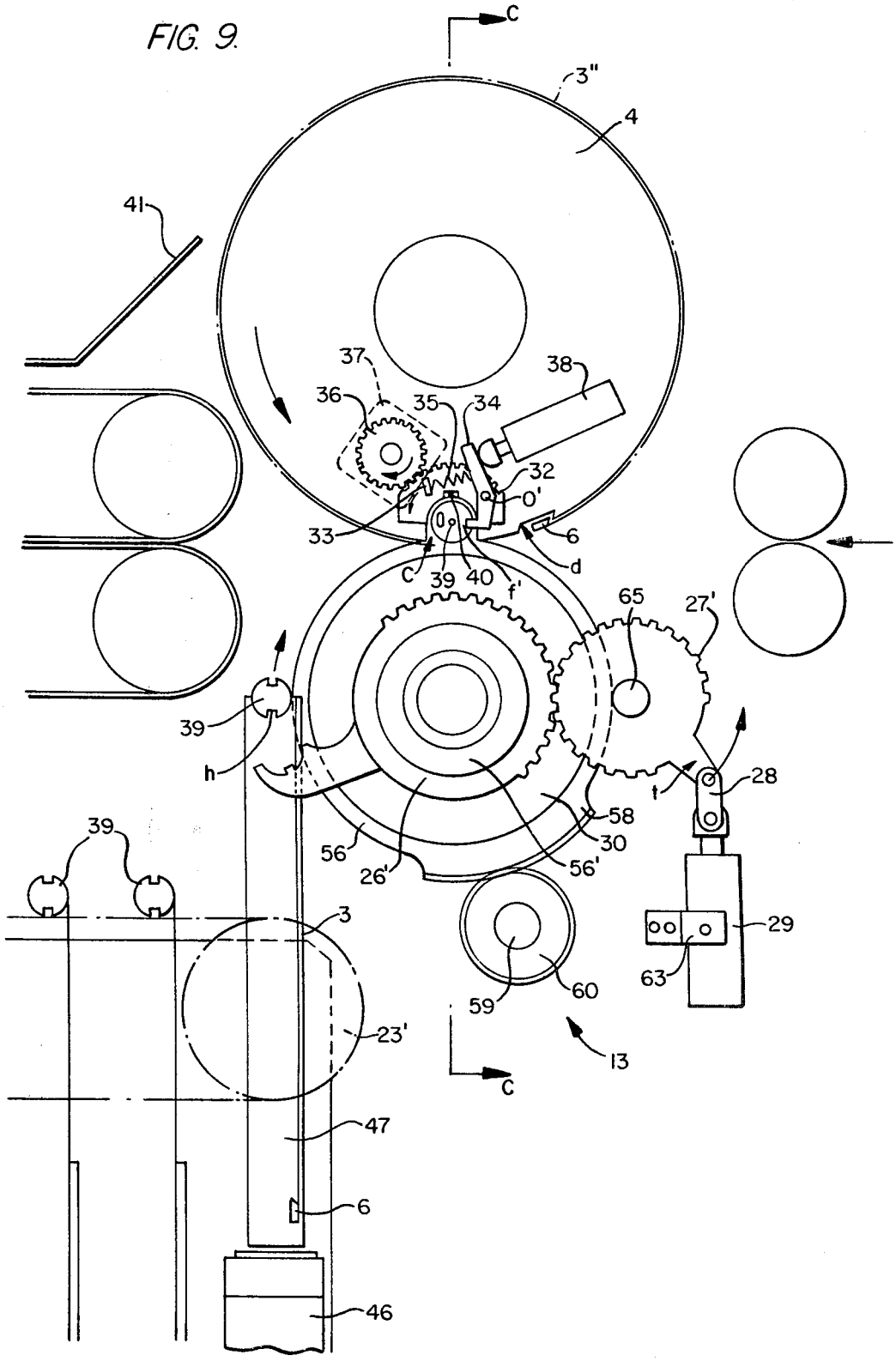
Figure 11A:
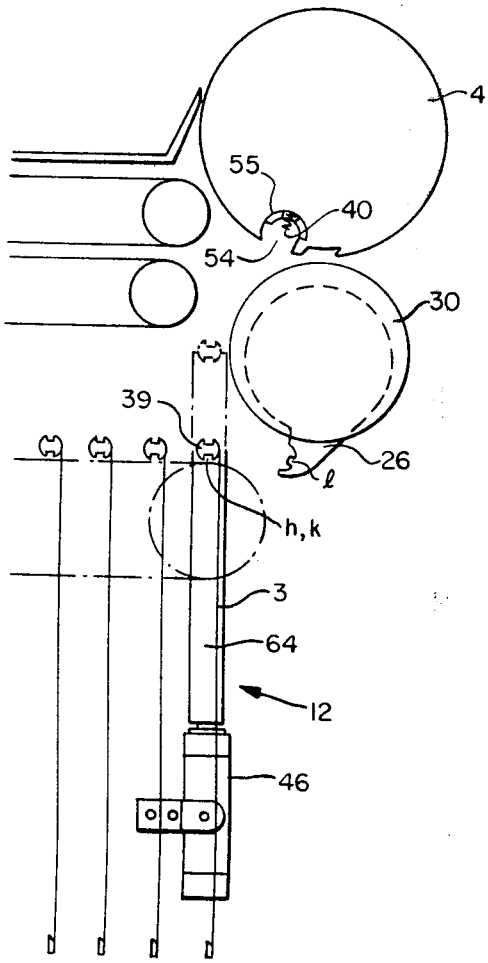
Figure 11B:
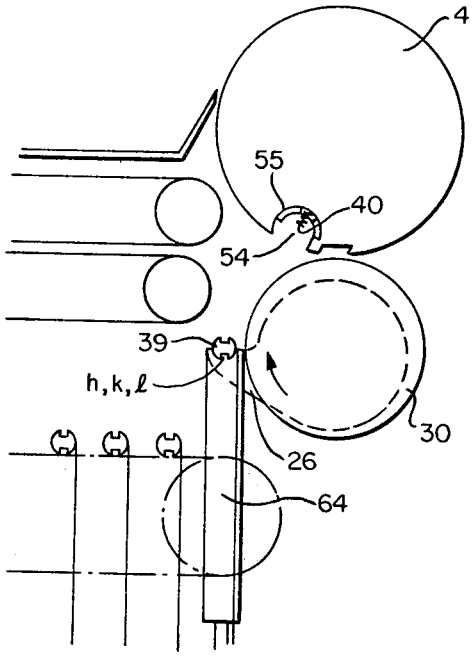
Figure 11C:
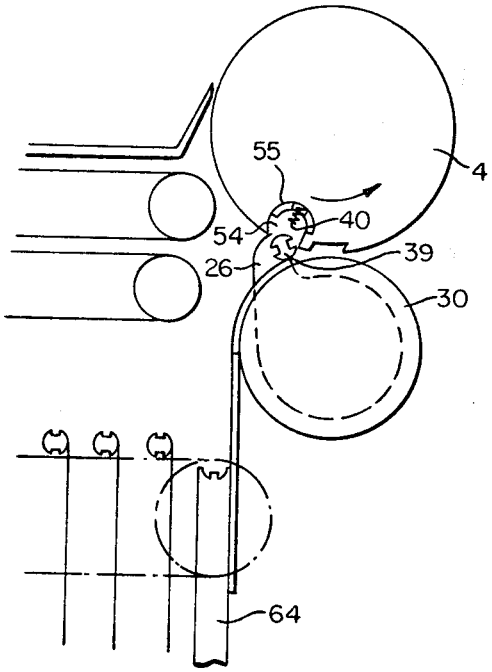
Figure 12A:
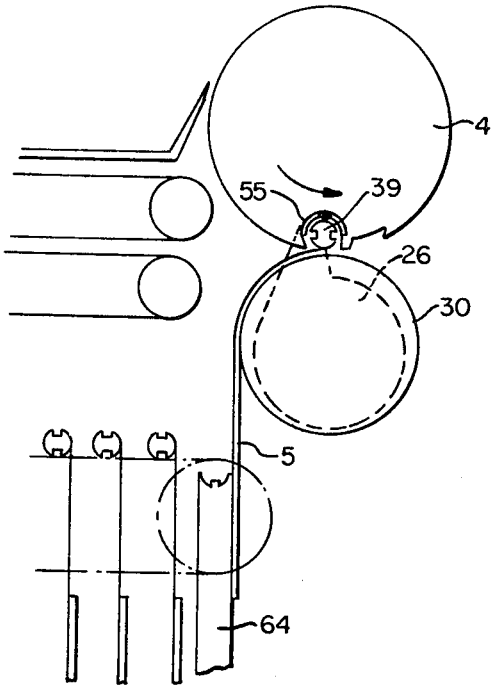
Figure 12B:
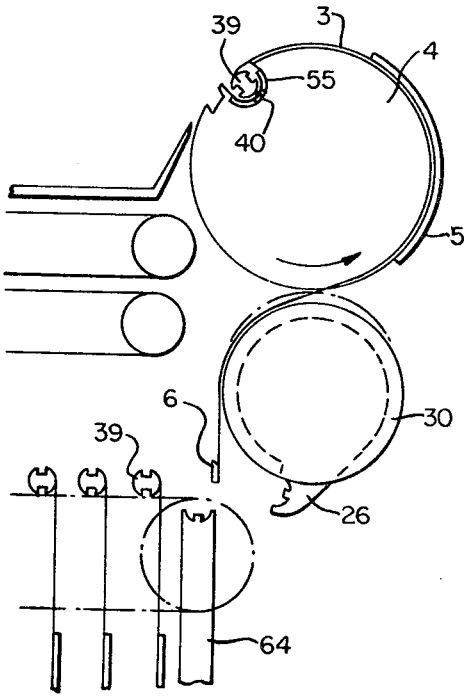
Figure 12D:
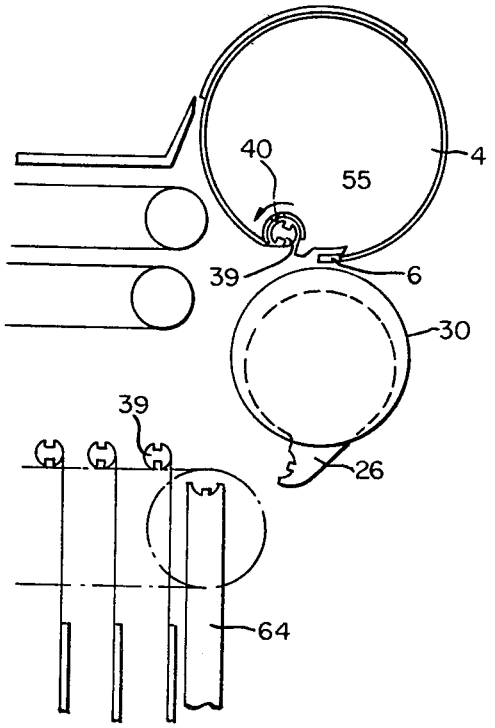
Figure 12C:
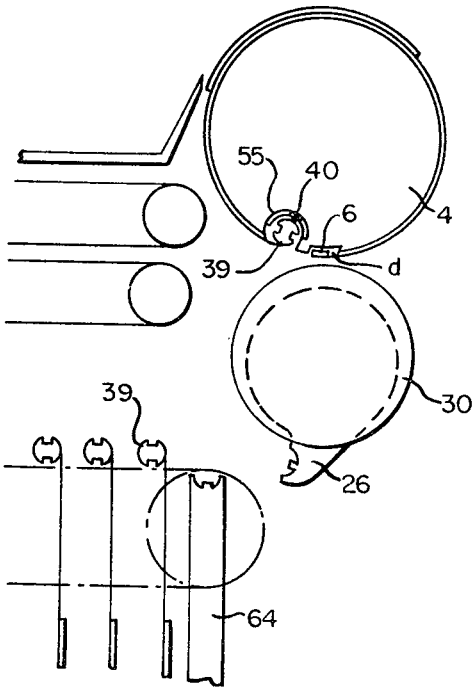
Figure 13A:
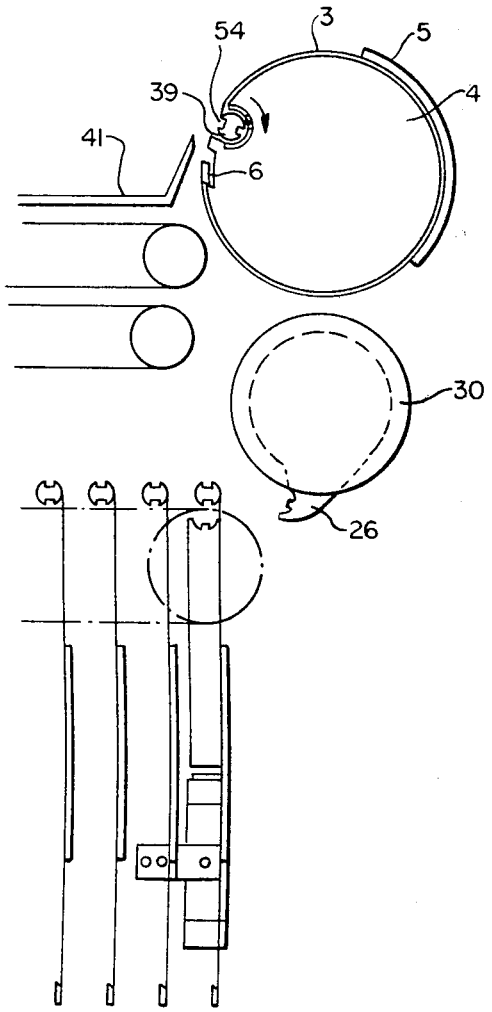
Figure 13B:
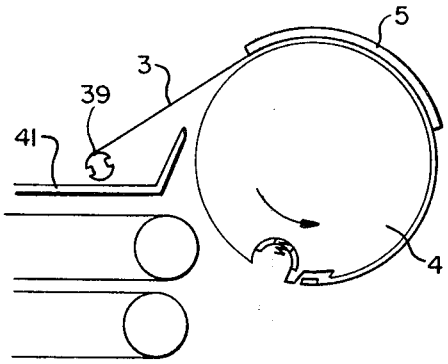
Figure 13C:
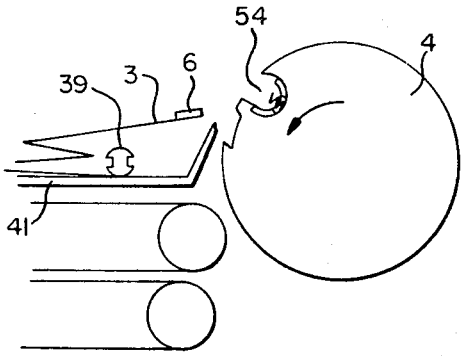
Figure 14:
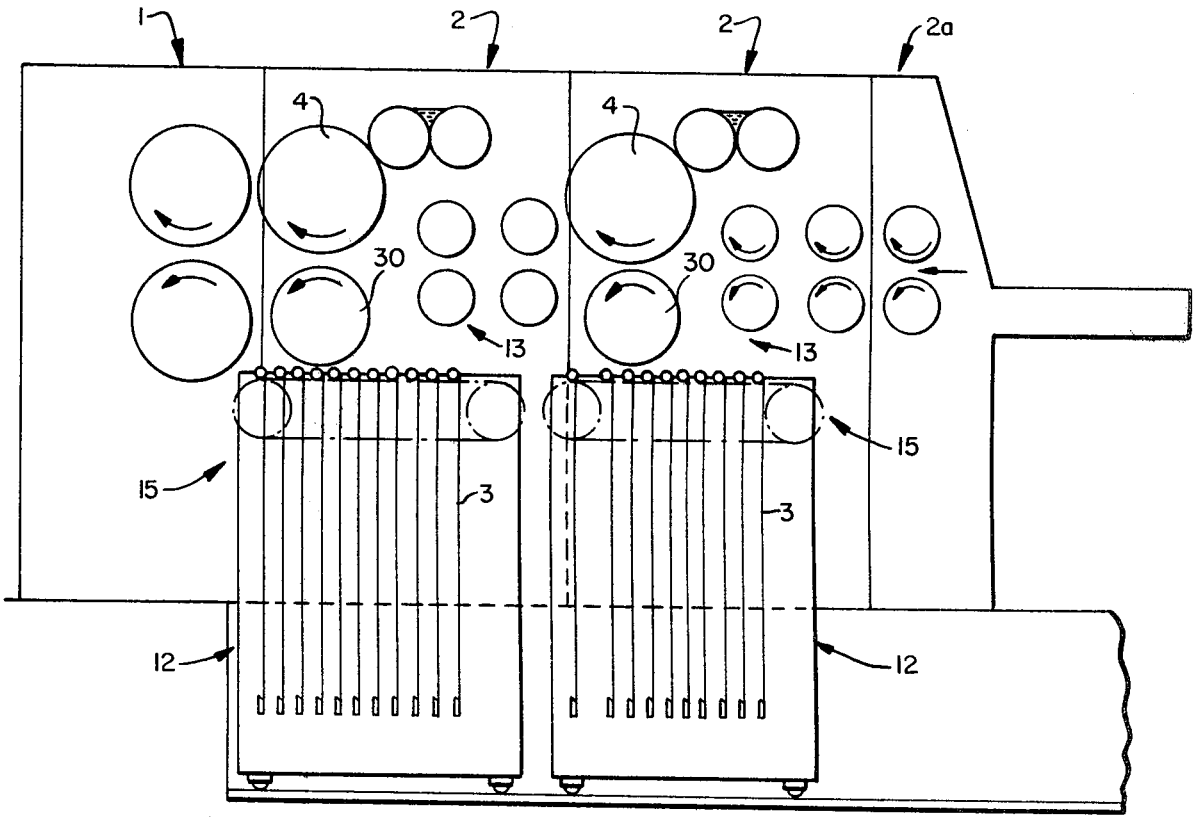

The above-mentioned and other features and objects of the present invention will become more apparent by reference to the following description of preferred embodiments of the invention taken in conjunction with the accompanying drawings, wherein:

FIG. 1 is a side view of a printing section of upper printing type in a paper working machine in the prior art, FIG. 2 is a perspective view of a plate sheet having a front fixture strip and a rear fixture strip attached thereto, FIGS. 3(*a*) and 3(*b*) are enlarged side views showing an essential part of a printing cylinder in FIG. 1, FIG. 4 is a side view of a printing plate exchange system according to one preferred embodiment of the present invention, FIG. 5 is a cross-section view taken along line A—A in FIG. 4, FIG. 6 is a cross-section view taken along line B—B in FIG. 4, FIG. 7 is an enlarged perspective view showing a fixture rod and a plate sheet mounted thereto in FIG. 4, FIG. 8 is a detailed view showing an essential part in FIG. 4, FIG. 9 is an enlarged view of an essential part in FIG. 4 taken along cross-section line D—D in FIG. 10, FIG. 10 is a cross-section view taken along line C—C in FIG. 9, FIGS. 11(*a*), 11(*b*) and 11(*c*), FIGS. 12(*a*), 12(*b*) 12(*c*) and 12(*d*) and FIGS. 13(*a*), 13(*b*) and 13(*c*), respectively, are side views showing a printing cylinder and associated members in successive steps of three different phases of operation, and FIG. 14 is a side view of a printing plate exchange system according to another preferred embodiment of the present invention.

Now the present invention will be described in greater detail in connection to its preferred embodiments illustrated in the accompanying drawings. A general construction of one preferred embodiment of the present invention as applied to a printing section of upper printing type, is shown in FIG. 4. The printing plate exchange system illustrated in FIG. 4 is composed of a plate preset apparatus (12) and an automatic plate mount/dismount apparatus (13). In addition, a sandwich conveyor (70) is provided for the purpose of conveying a printed paper sheet to a paper eject section. A unit box (15) containing the plate preset apparatus (12) therein has casters (14) attached to four corners of its bottom surface so as to be freely movable.

On the inside surface at the upper portion of the unit box (15) are fixedly secured two rails (16), and a frame (18) is supported by cam followers (17) and (17') interposed between these upper and lower rails (16) as hanging therefrom. In addition, the frame (18) is coupled to a cylinder (19) which is fixedly secured to the unit box (15), and further, on the frame (18) is fixedly secured another cylinder (20).

As shown in FIG. 6, a sprocket wheel (21) provided on a side surface of a one-way clutch (43) mounted on the same shaft as the cam follower (17) is coupled through a chain (22) to another sprocket wheel (21') which is rotatably mounted at a lower portion of the frame (18). In addition, sprocket wheels (23) and (23') are rotatably supported on the same shafts as the above-described cam followers (17) and (17'), respectively, at the upper portion of the frame (18), and coupled to each other through a conveyor chain (24).

Furthermore, as shown in FIGS. 4 and 5, at the tip end portion of a support rod (64) mounted at the tip end of a piston rod of a cylinder (46) fixedly secured to the frame (18), is provided a protrusion (k) which is adapted to fit into a slot (h) formed on the fixture rod (39). The slot (h) of the fixture rod (39) at the right-most position that is positioned at the level of the top ends of the sprockets (23) and (23'), is located on a vertical extension of the protrusion (k) of the support rod (64). Accordingly, the protrusion (k) can be fitted into the slot (h) by vertically moving the support rod (64), and so, the fixture rod (39) can be moved in the vertical direction integrally with the support rod (64) without varying the position of the slot (h).

On the other hand, as shown in FIG. 7, a rear fixture strip (7) of a plate sheet (3) is fitted into a slot (g) provided on the fixture rod (39) in parallel to its axis, and is held by claws (45) so as not to slip out. In addition, as shown in FIG. 8, a protrusion (i) of a special attachment (44) provided on the conveyor chain (24) is adapted to fit into the slot (h) formed on the fixture rod in parallel to its axis, and as a result, the angular positions of the slots (h) of the fixture rods (39) carried by the conveyor chain (24) as shown in FIG. 4 can be prevented from being displaced as the conveyor chain (24) moves. In addition, reference numeral (25) designates a piston rod of the cylinder (20), and this piston rod (25) is coupled to the chain (22) at a point (a) so that the chain can move in response to actuation of the cylinder (20).

The plate mount/dismount apparatus (13) is composed of a carrier arm (26), a wheel (27), a link (28), a cylinder (29) and the like, and its detailed structure is illustrated in FIGS. 9 and 10. FIG. 10 is a cross-section view taken along line C—C in FIG. 9. In FIG. 10, a printing cylinder (4) having its shaft carried between frames (47) and (47'), is rotatably supported, and a gear (48) is coupled to one end portion of the shaft. Another gear (49) meshed with the gear (48) is coupled via a clutch (50) to a motor (51), which is fixedly supported from the frame (47) through a base plate (52). In addition, on one end of the printing cylinder (4) is mounted a pulse generator (53) for the purpose of detecting an angle of rotation.

Furthermore, on the outer circumference of the printing cylinder (4) is provided a slot (54), and at the bottom of the slot (54) is fitted an inner cylinder (55) so as to be rotatable about a point 0 in FIG. 9. On the inside surface of the inner cylinder (55) are provided recesses at a number of positions aligned in the lengthwise direction, and springs (40) are fitted into the respective recesses. In addition, flange portions provided at the opposite end surfaces of the inner cylinder (55) are machined into sector gears (32). As shown in FIG. 9, a rotary cylinder (37) is mounted in the printing cylinder (4) at such position that a gear (36) mounted on the rotary shaft of the rotary cylinder (37) may mesh with the sector gear (32).

On the side surface of the sector gear (32) are mounted a spring seat (33) and a claw (34) that is rotatable about a point 0' on the sector gear (32) with a spring (35) pinched therebetween. Reference numeral (38) designates a cylinder which is fixedly secured onto a side surface of the printing cylinder (4) so that a tip end of a piston rod of the cylinder (38) may butt upon the claw (34). It is to be noted the above-described structure is provided on the both side surfaces of the printing cylinder (4).

Furthermore, a receiving roll (30) has its shaft mounted between the frames (47) and (47') in parallel to the printing cylinder (4), and it is rotatably supported via eccentric bushes (56) and (56'). The eccentric bushes (56) and (56') are rotatably mounted in the frames (47) and (47'), respectively. In addition, a gear (57) is coupled to one end of the shaft of the receiving roll (30), and the gear (57) is in turn meshed with the gear (48).

The eccentric bushes (56) and (56') are machined into sector gears (58) and (58'), respectively, and these sector gears (58) and (58') are meshed with pinions (60) and (60'), respectively, provided on a pinion shaft (59) that is pivotably supported between the frames (47) and (47') in parallel to the receiving roll (30). In addition, one end of the pinion shaft (59) is coupled to a motor (51), which is fixedly secured onto the frame (47') via a base plate (62).

On the other hand, carrier arms (26) and (26') rotatably mounted on the eccentric bushes (56) and (56'), respectively, are engraved gear teeth along about one-half of its circumference, and gears (27) and (27') are rotatably mounted on the frames (47) and (47'), respectively, at such position that the gears (27) and (27') may mesh with the gear teeth on the eccentric bushes (56) and (56'), respectively. These gears (27) and (27') are connected via a shaft (65) provided in parallel to the pinion shaft (59). Furthermore, the gear (27') provided on the frame (47') has a protrusion (t) on its outer circumference, which protrusion is coupled via a link (28) to the cylinder (29), and the cylinder (29) is in turn fixedly secured onto the frame (47') via a mount seat (63).

Now, operation of the above-described plate exchange system will be explained. A plate sheet group consisting of a necessary number of plate sheets (3) are preliminarily suspended from the conveyor chain (24) in the sequence of use thereof outside of the printing machine to preset the unit box (15), and after the thus preset unit box (15) has been fixedly placed within the printing machine, the frame (18) in the unit box (15) is moved up to the position where the right-most plate sheet (3) is placed at such position that it can be engaged with the carrier arm (26). The plate exchange system according to the present invention under the above-described state, is shown in FIG. 4. This movement of the frame (18) is effected by actuating the cylinder (19) in the direction of retracting its piston rod by operating a push-button switch (not shown).

Subsequent sequential advance of the plate sheets (3) is effected in the following manner. That is, if the chain (22) is driven by actuating the cylinder (20) in the direction of projecting its piston rod (25) by operating a push-button switch (not shown), then the sprocket wheel (21) fixed to the one-way clutch (43) is rotated, hence the sprocket wheel (23) mounted on the same shaft as the one-way clutch (43) is also rotated simultaneously so as to drive the conveyor chain (24), and for each one stroke of the cylinder (20) the one-way clutch (43) is actuated so as to lock the sprocket (23) and the conveyor chain (24) at the advanced position when the piston rod (25) is retracted. More particularly, when the cylinder (20) is actuated in the direction of retracting its piston rod (25), the chain (22) would be restored to its original position jointly with the piston rod (25) while the conveyor chain (24) is kept stopped, and thereafter, the series of plate sheets (3) are sequentially and intermittently advanced by repeating the above-described projection and retraction of the piston rod (25) of the cylinder (20).

Now, referring to FIGS. 11(*a*), 11(*b*) and 11(*c*), when the support rod (64) is raised by actuating the cylinder (46) provided on the preset apparatus for the purpose of moving the fixture rod (39) of the plate sheet (3) set on the preset apparatus (12) up to the position where it can be engaged with the carrier arm (26) (the position shown by double-dot chain lines in FIG. 11(*a*)), the projection (k) provided at the tip end of the support rod (64) would fit into the slot (h) provided on the fixture rod (39), so that the fixture rod (39) can be moved without changing its angular position while it is being raised. It is to be noted that FIG. 11(*a*) shows the state where the projection (k) of the support rod (64) has fitted into the slot (h) of the fixture rod (39).

FIG. 11(*b*) shows the state where the support rod (64) has reached its stroke end, the gear (27') has been rotated via the link (28) by actuating the cylinder (29) not shown in FIG. 11, hence the carrier arm (26) has rotated in the direction of an arrow, and a protrusion (1) of the carrier arm (26) has fitted into the slot (h) of the fixture rod (39). As a result, during the rotation of the carrier arm (26), the angular position of the fixture rod (39) relative to the carrier arm (26) can be prevented from deviating.

FIG. 11(*c*) shows the state where the fixture rod (39) has reached the slot (54) on the printing cylinder (4) which was preliminarily disposed at its standby position as a result of rotation of the carrier arm (26). On the other hand, the support rod (64) which has delivered the fixture rod (39) to the carrier arm (26), is lowered to its standby position (the position shown by solid lines in FIG. 11(*c*)) by actuating the cylinder (46).

Now, if the motor (51) is actuated after the clutch (50) shown in FIG. 10 has been connected under the state shown in FIG. 11(*c*), then the printing cylinder (4) is rotated in the direction of an arrow, and the fixture rod (39) is fitted into the slot (54) on the printing cylinder (4) while urging the springs (40) provided in the slot (54). This state is shown in FIG. 12(*a*). At this moment, if the cylinder (38) shown in FIG. 9 is actuated in the direction of retracting the piston rod, then the claw (34) would fit into the slot (f) of the fixture rod (39) and also it is locked not to come out by an urging force of the spring (35), so that the fixture rod (39) can be fixed in the slot (54).

On the other hand, the plate (5) cannot pass through the gap space between the printing roll (4) and the receiving roll (30) shown in FIG. 12(*a*), hence the receiving roll (30) is lowered from the position shown by double-dot chain lines to the position shown by solid lines in FIG. 12(*b*) by rotating the eccentric bushes (58) and (58') by actuating the motor (61) shown in FIG. 10, and thus the plate sheet (3) can be wrapped around the outer circumference of the printing cylinder (4) as the printing cylinder is rotated. On the other hand, the carrier arm (26) which has delivered the fixture rod (39) onto the printing cylinder (4), is rotated up to the standby position shown in FIG. 12(*b*) in response to a retracting operation of the cylinder (29) via the link (28) and the gear (27').

In FIG. 12(*c*), when the front fixture strip (6) of the plate sheet (3) has reached onto the plane including the center axes of the printing cylinder (4) and the receiving roll (30), the motor (51) in FIG. 10 is stopped and the connection of the clutch (50) is released.

Subsequently, the receiving roll (30) disposed at the position shown by solid lines in FIG. 12(*b*) is again raised by the actuation of the motor (61) and eventually reaches the position shown by solid lines in FIG. 12(*c*). As a result, the front fixture strip (6) is fitted into a slot (d) provided on the circumference of the printing cylinder (4).

Then, the rotary cylinder (37) shown in FIG. 9 is actuated, hence the sector gear (32) is rotated via the gear (36), at the same time the inner cylinder (55) in FIG. 10 is also rotated in the direction of an arrow to make the front fixture strip (6) tightly contact with the edge of the slot (d) on the printing cylinder (4) and apply a tension to the plate sheet (3), and further the fixture rod (39) is fixed in position as wrapped by the inner cylinder (55). The above-described state is shown in FIG. 12(*d*).

Now description will be made on the dismounting operation for the plate sheet (3). At first, the clutch (50) shown in FIG. 10 is again connected and the motor (51) is actuated. Thereby, the slot (54) on the printing cylinder (4) is moved up to the position shown in FIG. 13(*a*), and then the motor (51) is stopped.

Under the above-mentioned state, the rotary cylinder (37) is again actuated to rotate the sector gear (32) in the direction of an arrow. Thereby the tension of the plate sheet (3) is relaxed, and so, the fixture rod (39) is ejected from the slot (54) onto a receiver pan (41) by an urging force of the springs (40) provided on the inside surface of the inner cylinder (55).

Subsequently, the motor (51) is again actuated, and as the printing cylinder (4) is rotated in the direction of an arrow, the plate sheet (3) is recovered in the receiver pan (41) (FIG. 13(*b*)). When the slot (54) on the printing cylinder has reached the position shown in FIG. 13(*c*), the recovery of the plate sheet (3) is completed, hence the motor (51) is stopped and the connection of the clutch (50) is also released.

FIG. 14 shows a second preferred embodiment of the present invention, in which unit boxes (15) each containing a plate sheet preset apparatus (12) and an automatic plate mount/dismount apparatus (13) therein are respectively fixed within printing sections (2), (2) disposed in juxtaposition between a paper eject section (1)

and a paper feed section (2*a*). According to this embodiment, the unit box need not be drawn out of the printing machine, so that a small margin floor area of a factory where the machine is installed can suffice, also the sandwich conveyor connecting the adjacent units becomes unnecessary, and therefore, a setup time can be reduced and a safety can be improved.

Since the printing plate exchange system according to the present invention is constructed as described above, as compared to the manual operation system in the prior art, it becomes unnecessary to release the frames of the printing section and the paper feed section for the purpose of reserving a space for manual operation each time the plate is to be exchanged, also the plate sheets can be preset, and automatic mounting and dismounting of a plate sheet onto and from a printing cylinder can be achieved. Therefore, a time required for setup is greatly shortened, hence a productivity can be enchanced by the corresponding amount, and also improvements in saving labor and in safety can be achieved.

Since many modifications could be made in the above construction and many apparently widely different embodiments of this invention could be made without departing from the scope thereof, it is intended that all matter contained in the above description or shown in the accompanying drawings shall be interpreted as illustrative and not as a limitation to the scope of the invention.

What is claimed is:

1. A printing plate exchange system comprising a unit box holding therein a plurality of plates each mounted to a fixture rod and capable of being disposed under a printing cylinder, said fixture rod having a slot adapted to engage with a fixture strip of the plate and a holding member for preventing the fixture strip from disengaging therefrom, and plate mount/dismount means disposed under said printing cylinder for mounting and dismounting the plate in said unit box onto and from said printing cylinder by the intermediary of said fixture rod.

* * * * *